US008235480B2

(12) United States Patent
Kang

(10) Patent No.: US 8,235,480 B2
(45) Date of Patent: Aug. 7, 2012

(54) DOOR HINGE ASSEMBLY FOR REFRIGERATOR AND METHOD OF ASSEMBLING THE SAME

(75) Inventor: Wonsik Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/863,160

(22) PCT Filed: Nov. 18, 2008

(86) PCT No.: PCT/KR2008/006772

§ 371 (c)(1),
(2), (4) Date: Jul. 15, 2010

(87) PCT Pub. No.: WO2009/093800

PCT Pub. Date: Jul. 30, 2009

(65) Prior Publication Data

US 2011/0050067 A1 Mar. 3, 2011

(30) Foreign Application Priority Data

Jan. 21, 2008 (KR) ..... 10-2008-0006101

(51) Int. Cl.
*A47B 96/04* (2006.01)

(52) U.S. Cl. ..... 312/405; 16/266; 16/268; 16/260

(58) Field of Classification Search ..... 312/405, 312/326–329, 138.1, 109; 49/381, 385, 388, 49/399; 16/266, 268, 260; 62/440, 441
See application file for complete search history.

(56) References Cited

U.S. PATENT DOCUMENTS

| | | | | | |
|---|---|---|---|---|---|
| 2,593,177 | A | * | 4/1952 | Patterson | 297/423.16 |
| 2,847,238 | A | * | 8/1958 | Bolling, Jr. | 403/154 |
| 2,867,839 | A | * | 1/1959 | Squire | 16/358 |
| 3,103,692 | A | * | 9/1963 | Ruck, Jr. et al. | 16/82 |
| 3,628,845 | A | * | 12/1971 | Grimm | 312/309 |
| 3,766,599 | A | * | 10/1973 | Ullman, Jr. | 16/257 |
| 3,869,753 | A | * | 3/1975 | Boback | 16/382 |
| 3,980,331 | A | * | 9/1976 | Kennedy et al. | 292/268 |
| 4,090,274 | A | * | 5/1978 | Bourgeois | 16/317 |
| 4,609,234 | A | * | 9/1986 | Naniwa et al. | 312/296 |
| 4,690,443 | A | * | 9/1987 | Brammall | 292/307 R |
| 4,771,506 | A | * | 9/1988 | Allen | 16/251 |

(Continued)

FOREIGN PATENT DOCUMENTS

KR 1997-0028353 A 6/1997

(Continued)

OTHER PUBLICATIONS

Translation of Korean Patent Document (KR-10-2004-0102383).*

*Primary Examiner* — Darnell Jayne
*Assistant Examiner* — Hiwot Tefera
(74) *Attorney, Agent, or Firm* — Birch, Stewart, Kolasch & Birch, LLP

(57) ABSTRACT

A door hinge assembly for a refrigerator includes a refrigerator door pivotally coupled to a main body of the refrigerator and provided with at least one groove and a hinge unit enabling the refrigerator door to pivot. The hinge unit includes a hinge pin providing a pivot axis of the refrigerator door and a hook member provided at a side of the hinge pin and inserted and hooked in the groove.

2 Claims, 4 Drawing Sheets

U.S. PATENT DOCUMENTS

| | | | | | |
|---|---|---|---|---|---|
| 4,800,678 | A | * | 1/1989 | Loos | 49/394 |
| 4,905,347 | A | * | 3/1990 | Wroth | 16/308 |
| 4,932,729 | A | * | 6/1990 | Thompson et al. | 312/405 |
| 4,936,612 | A | * | 6/1990 | Kohn | 292/327 |
| 5,187,837 | A | * | 2/1993 | Gunderson et al. | 16/375 |
| 5,244,273 | A | * | 9/1993 | Kaspar et al. | 312/405 |
| 5,411,328 | A | * | 5/1995 | You | 312/405 |
| 5,931,554 | A | * | 8/1999 | Koopman | 312/405 |
| 5,954,413 | A | * | 9/1999 | Brown | 312/328 |
| 6,070,300 | A | * | 6/2000 | Shin et al. | 16/382 |
| 6,128,807 | A | * | 10/2000 | Lim et al. | 16/266 |
| 6,622,345 | B2 | * | 9/2003 | Liu et al. | 16/357 |
| 7,155,776 | B2 | * | 1/2007 | Park | 16/50 |
| 7,506,474 | B2 | * | 3/2009 | Yoshikawa et al. | 49/257 |
| 7,617,634 | B2 | * | 11/2009 | Leimkuehler et al. | 49/501 |
| 7,634,837 | B2 | * | 12/2009 | Schluter et al. | 16/260 |
| 2006/0244351 | A1 | * | 11/2006 | Moon et al. | 312/405 |
| 2007/0216271 | A1 | * | 9/2007 | Tarantik | 312/405 |
| 2008/0048539 | A1 | * | 2/2008 | Beek et al. | 312/405 |

FOREIGN PATENT DOCUMENTS

| | | | |
|---|---|---|---|
| KR | 2001-0009547 | A | 2/2001 |
| KR | 10-2004-0102383 | A | 12/2004 |

* cited by examiner

[Fig. 1]
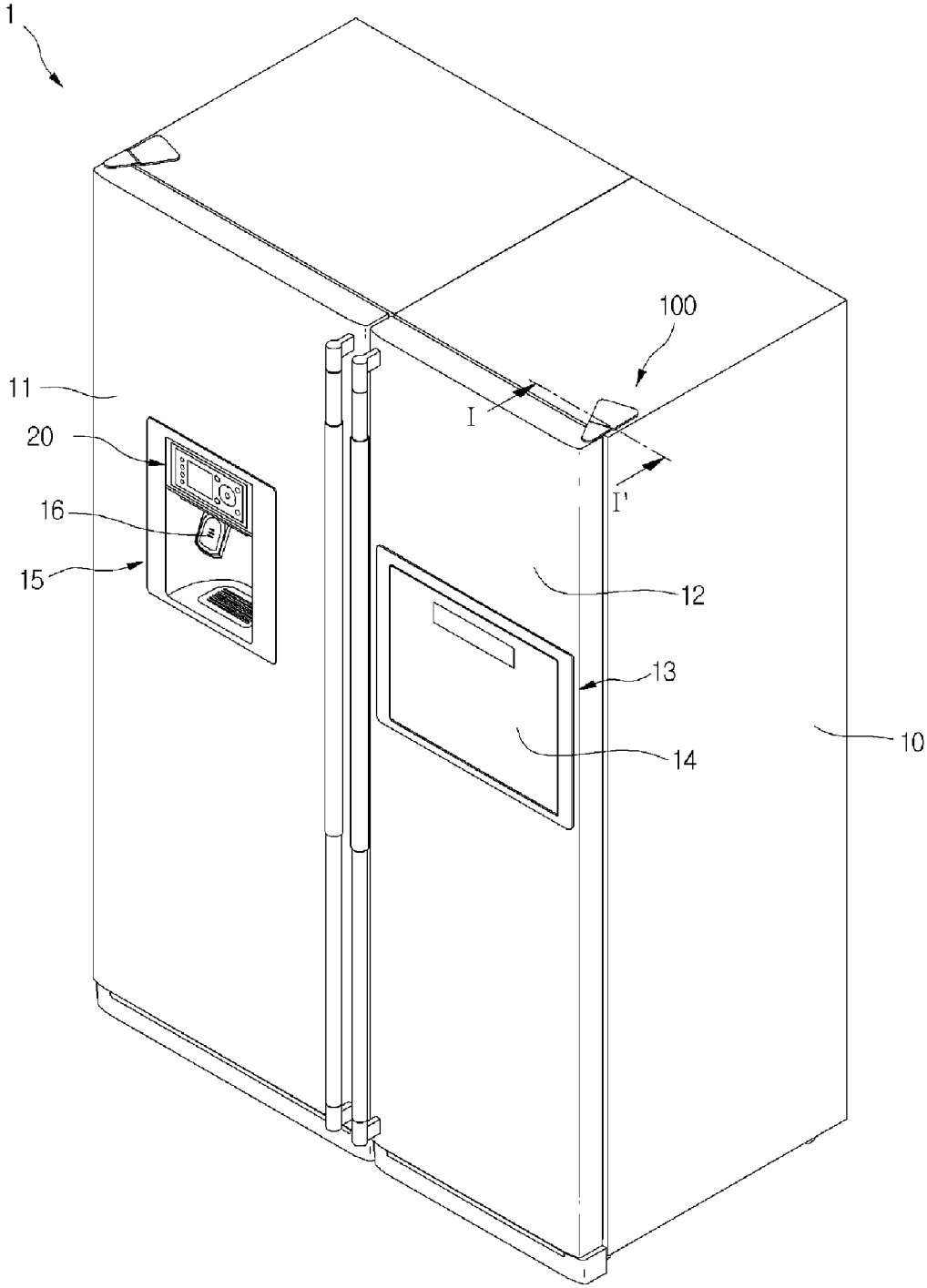

[Fig. 2]
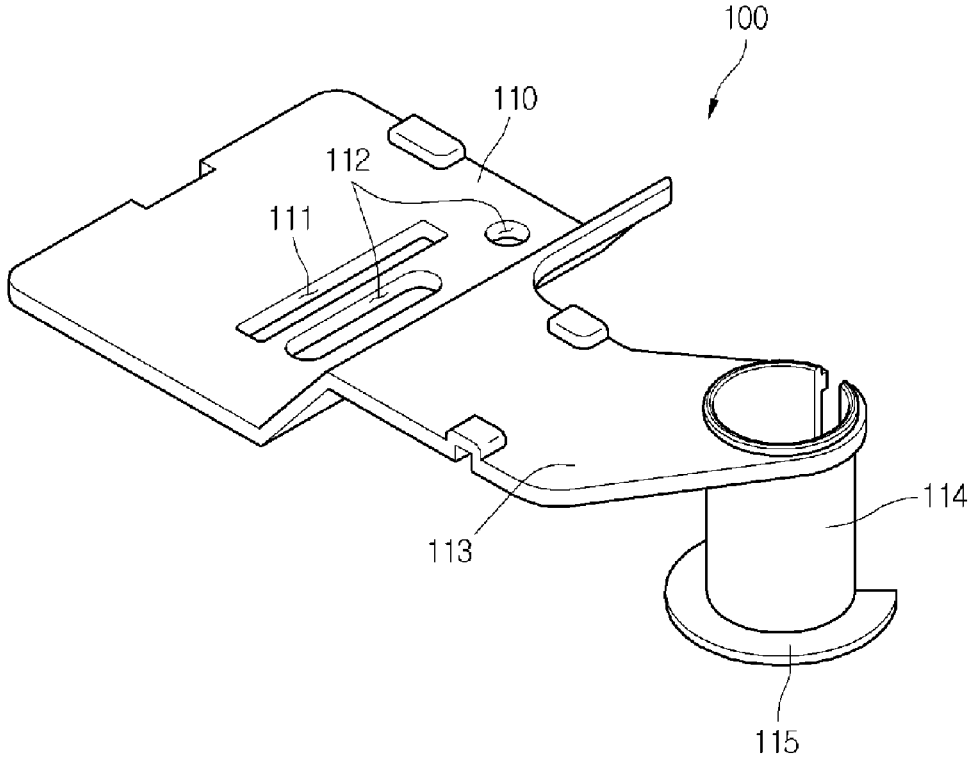
[Fig. 3]
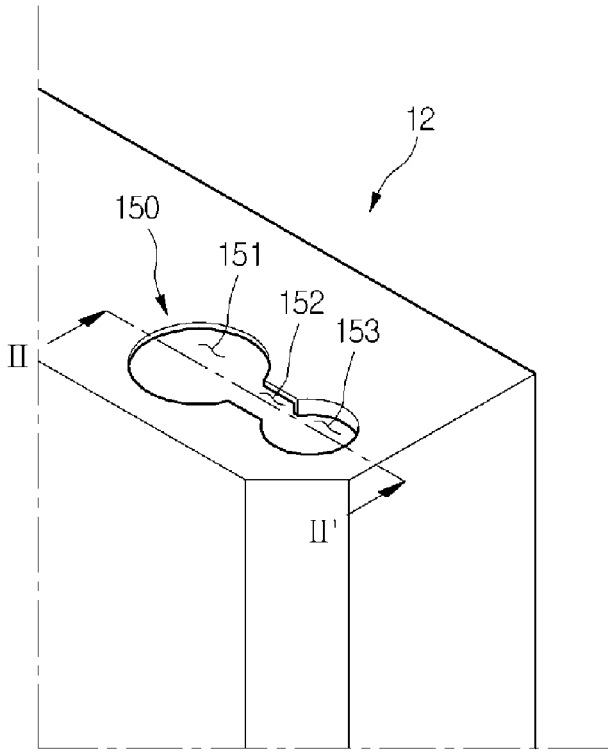

[Fig. 4]
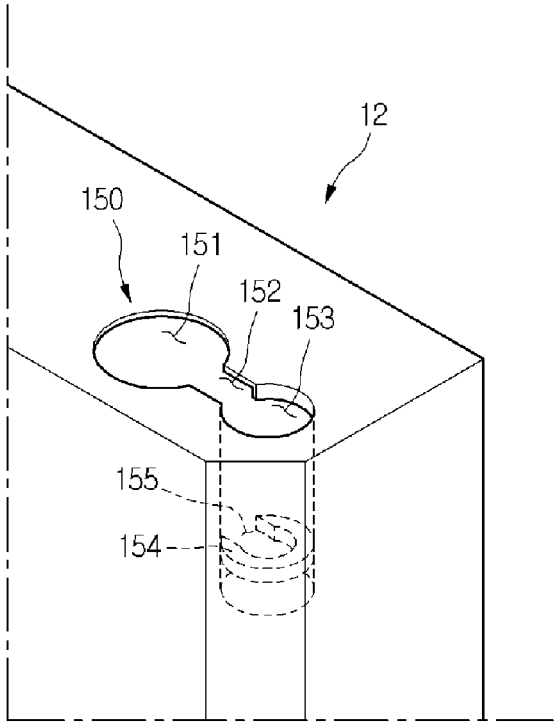
[Fig. 5]
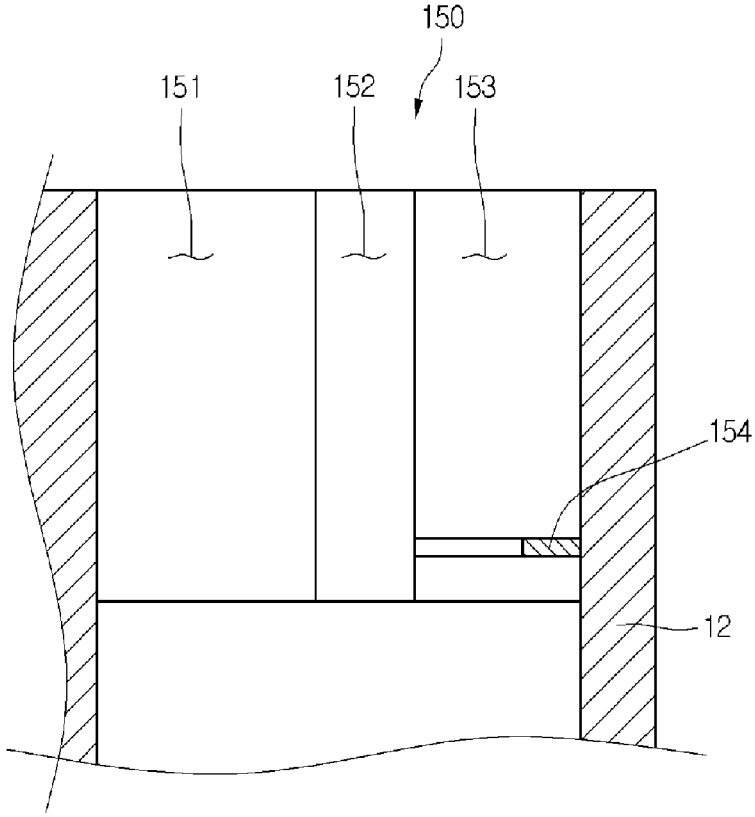

[Fig. 6]
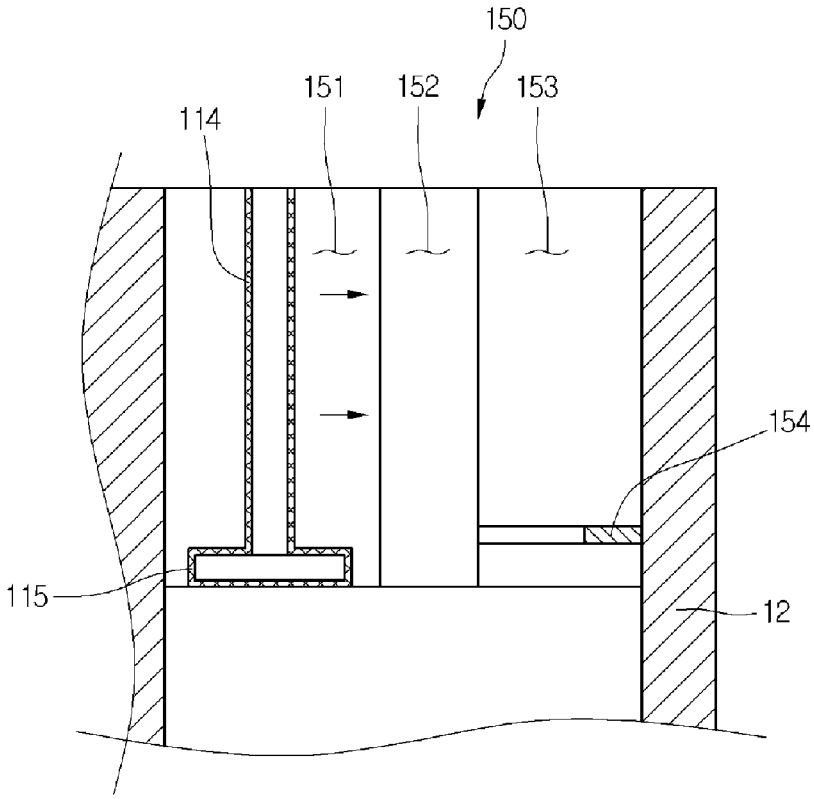
[Fig. 7]
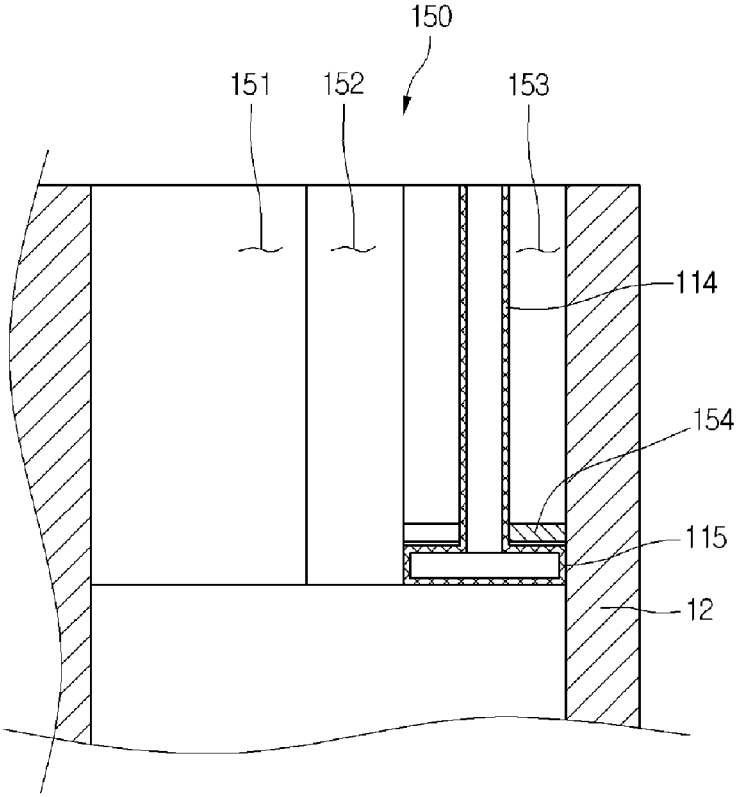

DOOR HINGE ASSEMBLY FOR REFRIGERATOR AND METHOD OF ASSEMBLING THE SAME

BACKGROUND

The present disclosure relates to a door hinge assembly for a refrigerator and a method of assembling the same.

Generally, a refrigerator is an electrical appliance that keeps food fresh for a long time by maintaining an interior temperature thereof to be lower than an exterior temperature.

The refrigerator generates cool air as a refrigerant circulates a cooling cycle and supplies the cool air to a storage chamber to maintain the food in the storage chamber at a predetermined low temperature.

The storage chamber is defined by a main body of the refrigerator. In order to prevent the cool air in the storage chamber from leaking, a door is installed on the main body of the refrigerator. Generally, the door is pivotally installed on a side of the main body. At this point, a hinge unit may be provided on the main body to provide a pivot axis of the door.

Meanwhile, according to the related art refrigerator, the hinge unit cannot function to support the load of the refrigerator but simply provides the pivot axis.

In addition, as a volume of the refrigerator increases and thus a weight of the refrigerator door increases, the refrigerator door slips at a coupling portion to the hinge unit or droops.

Accordingly, the refrigerator door cannot pivot with it closely contacting the main body of the refrigerator and a step between the main body and the door is created. When the step increases above a predetermined level, the refrigerator door cannot smoothly pivot.

SUMMARY

Embodiments provide a door hinge assembly for a refrigerator, which is configured such that a hinge unit supports the load of a refrigerator door by improving structures of the hinge unit and refrigerator door.

Embodiments also provide a door hinge assembly for a refrigerator, which is configured to reduce drooping of a refrigerator door by a hinge unit supporting the refrigerator door.

In one embodiment, a door hinge assembly for a refrigerator includes: a refrigerator door pivotally coupled to a main body of the refrigerator and provided with at least one groove; and a hinge unit enabling the refrigerator door to pivot, wherein the hinge unit includes: a hinge pin providing a pivot axis of the refrigerator door; and a hook member provided at a side of the hinge pin and inserted and hooked in the groove.

In another embodiment, a door hinge assembly for a refrigerator includes: a refrigerator main body defining a storage chamber; a refrigerator door pivotally provided on the refrigerator main body; and a hinge unit provided on the refrigerator main body and pivotally supporting the refrigerator door, wherein the refrigerator door includes: an insertion groove in which the hinge unit is inserted; and a hook groove enabling the hinge unit to be hooked on the refrigerator door.

In still another embodiment, a method of assembly a hinge of a refrigerator door includes: inserting a hinge pin and a hook member in an insertion groove of a refrigerator door; moving the hinge pin and the hook member to a hook groove of the refrigerator door; supporting the hook member using a hook rib provided in the hook groove; and coupling a hinge main body to a refrigerator main body.

The details of one or more embodiments are set forth in the accompanying drawings and the description below. Other features will be apparent from the description and drawings, and from the claims.

According to the embodiments, since a hook structure by which the refrigerator door is supported on the hinge unit, the drooping of the refrigerator due to the self-gravity of the refrigerator can be prevented.

In addition, since a groove in which the hinge unit is inserted and coupled is formed on the refrigerator door, the hinge unit can be easily assembled with the refrigerator door.

Further, even when the refrigerator door is repeatedly opened and closed, the door does not droop and thus the refrigerator door can effectively seal the main body, thereby preventing the leakage of the cool air in the refrigerator to an external side.

BRIEF DESCRIPTION OF THE DRAWINGS

FIG. 1 is a perspective view of a refrigerator according to an embodiment.

FIG. 2 is a perspective view of a hinge unit according to an embodiment.

FIG. 3 is a perspective view illustrating a structure by which the hinge unit is coupled to a refrigerator door.

FIG. 4 is a perspective view of a hook groove of a refrigerator door according to an embodiment.

FIG. 5 is a cross-sectional view taken along line II-II' of FIG. 3.

FIG. 6 is a cross-sectional view illustrating a state where a hinge unit is coupled to a refrigerator door according to an embodiment.

FIG. 7 is a cross-sectional view taken along line I-I' of FIG. 1.

DETAILED DESCRIPTION OF THE EMBODIMENTS

Reference will now be made in detail to the embodiments of the present disclosure, examples of which are illustrated in the accompanying drawings. It should be understood that numerous other modifications and embodiments can be devised by those skilled in the art that will fall within the spirit and scope of the principles of this disclosure.

FIG. 1 is a perspective view of a refrigerator according to an embodiment.

Referring to FIG. 1, a refrigerator 1 according to an embodiment includes a main body 10 and freezing and chilling chamber doors 11 and 12 that are pivotally installed on a front portion of the main body 10 to selectively open and close respective freezing and chilling chambers.

In the embodiment, a side-by-side type refrigerator having freezing and chilling chambers disposed at left and right sides will be exemplarily described. However, it should be understood that the present disclosure is not limited to the side-by-side type refrigerator. That is, the concept of the present disclosure can be applied to not only a top mount type refrigerator having a freezing chamber provided above a chilling chamber but also a bottom freezer type refrigerator having a freezing chamber provided under a chilling chamber.

In more detail, the chilling chamber door 12 is provided with a home bar 13 that allows a user to take out food without opening the chilling chamber door 12. The home bar 13 includes a home bar door 14. Since the home bar 13 is opened only when it is required, the cool air outflow can be minimized.

A dispenser unit 15 is formed on the freezing chamber door 11 to allow the user to take ice or water at an exterior of the refrigerator 1. The dispenser unit 15 includes a dispensing lever 16 for dispensing the ice or water.

Meanwhile, although not shown in the drawing of FIG. 1, an ice-making apparatus and a water tank for storing the water may be further provided on the freezing chamber door 11.

A display unit 20 is provided on a front surface of the freezing chamber door 11 to display a current operation state of the refrigerator 1. The display unit may be detachably mounted on the freezing chamber door 11.

In more detail, the dispenser unit 15 is recessed into the freezing chamber door 11 and the water or ice is dispensed by manipulating the dispensing lever 16.

Meanwhile, hinge units 100 for providing a pivot axis of each of the refrigerator doors 12 and 13 during opening and closing of the refrigerator doors 12 and 13 are provided on the refrigerator main body 10.

The hinge units 100 are provided on the upper end of the main body 10 and coupled to respective upper ends of the refrigerator doors 12 and 13.

In the following description, an upper hinge unit provided at the upper portion of the refrigerator main body 10 will be exemplarily described. However, the hinge unit according to the embodiment is not limited to the upper hinge unit but applied to the intermediate or lower hinges.

FIG. 2 is a perspective view of the hinge unit according to an embodiment.

Referring to FIG. 2, the hinge unit 100 according to the embodiment includes a hinge main body 110 fixed to the refrigerator main body 10, a pin connection member 113 extending outward from the hinge main body 110, a hinge pin 114 coupled to the pin connection member 113 and providing a pivot axis of the refrigerator door 11 (12). Here, the pin connection member 113 may be integrally formed with the hinge main body 110.

In more detail, the hinge main body 110 is provided with an insertion portion 111 in which a hinge bracket (not shown) is inserted such that the hinge main body 110 is coupled to the refrigerator main body 10. Here, a first side of the hinge bracket is coupled to the refrigerator main body 10 and a second side of the hinge bracket is inserted and hooked through the hinge main body 110.

The hinge main body 110 is provided with a coupling hole 112 through which a screw is coupled such that the hinge main body 110 is supported on the refrigerator main body 10.

The pin connection member 113 is formed in a plate shape extending outward from the hinge main body 110. The hinge pin 114 is coupled to a side of the pin connection member 113.

The hinge pin 114 is formed in a cylindrical shape. A first end portion of the pin connection member 113 is shaped to correspond to an outer circumference of the hinge pin 114. That is, the pin connection member 113 is coupled to the outer circumference of the hinge pin 114. On the contrary, the pin connection member 113 and the hinge pin 114 may be integrally formed with each other.

The hinge pin 113 extends downward from a coupling portion to the pin connection member 113.

A hook member 115 for hooking the hinge unit 100 on the refrigerator door 11 (12) is provided at a lower end of the hinge pin 114.

The hook member 115 extends outward from the hinge pin 114, enclosing the outer circumference of the hinge pin 114. That is, the hook member 115 has a greater diameter than the hinge pin 114.

Here, the hook member 115 may be designed to hole on a hook groove (that will be described later) of the refrigerator door 11 (12) during an assembling process of the hinge unit 100 with the refrigerator door 11 (12).

FIG. 3 is a perspective view of the refrigerator door to which the hinge unit is coupled, FIG. 4 is a perspective view illustrating the hook groove of the refrigerator door, and FIG. 5 is a cross-sectional view taken along line II-II' of FIG. 3.

Referring to FIGS. 3 through 5, the chilling chamber door 12 according to the embodiment includes an assembling portion 150 to which the hinge unit 100 is coupled. The assembling portion 150 is formed through a top surface of the chilling chamber door 12.

In more detail, the assembling portion 150 includes an insertion groove 151 in which the hinge unit 100 is inserted during the assembling of the hinge unit 100 with the chilling chamber door 12, a hook groove 153 that is hooked with the hinge unit 100 in a state where the assembly of the hinge unit 100 is completed, and a connection groove 152 communicating the insertion groove 151 with the hook groove 153.

The insertion groove 151, hook groove 153, and connection groove 152 are formed by being depressed downward from the top surface of the chilling chamber door 12.

Here, depths of the grooves 151, 152, and 153 are determined to degrees to which the hinge pin 114 and hook member 115 are completely inserted. Further, bottom surfaces of the grooves 151, 152, and 153 are on the same horizontal plane.

The insertion groove 151 and hook groove 153 are formed to correspond to shapes of the hinge pin 114 and hook member 115 and have circular-shaped sections taken in the horizontal direction.

The insertion groove 151 has a greater diameter than the hook member 115 so that the hinge pin 114 and hook member 115 can be simultaneously inserted therein.

The connection groove 152 is sized such that the hinge pin 114 and hook member 115 are capable of moving therein. That is, a groove having a greater diameter than the hinge pin 114 and hook member 115 are formed at a location of the interior of the connection groove 152, which corresponds to the hinge pin 114 and hook member 115.

Meanwhile, a hook rib 154 that is hooked with the hook member 115 in a state where the hinge unit 100 is assembled with the chilling chamber door 12 is provided in the hook groove 153.

The hook rib 154 extends from and along the inner circumference of the hook groove 153. An inner surface of the hook rib 154 is shaped to correspond to an outer circumference of the hinge pin 114.

The hook rib 154 is spaced upward from a bottom surface of the hook groove 153 by a predetermined distance. The predetermined distance is greater than a height of the hook member 115. In this case, the hook member 115 may be positioned under the hook rib 154 in a state where the hinge pin 114 and hook member 115 are inserted in the hook groove 153.

Further, the hook rib 154 is provided with an opening portion, at least a portion of which is opened so that the hinge pin 114 can move from the connection groove 152 to the hook groove 153. Here, the opening portion 155 may be larger than a diameter of the hinge pin 114.

At this point, the opening portion 155 may be smaller than the hook member 115 to prevent the hook member 115 from being released from the hook rib 154.

The following will describe a process for assembling the hinge unit 100 with the chilling chamber door 12 with reference to the accompanying drawings.

FIG. 6 is a cross-sectional view illustrating a state where the hinge unit is coupled to the refrigerator door according to the embodiment, and FIG. 7 is a cross-sectional view taken along line I-I' of FIG. 1.

Referring to FIGS. 6 and 7, the hinge unit 100 according to the embodiment is inserted into the insertion hole 151 of the chilling chamber door 12 and hooked in the hook groove 153.

That is, the hinge pin 114 and hook member 115 of the hinge unit 100 are simultaneously inserted into the insertion groove 151.

Further, in a state where the hinge pin 114 and hook member 115 are inserted into the insertion groove 151, the hinge pin 114 and hook member 115 may move to the hook groove 153 via the connection groove 152.

In addition, when the hinge pin 114 is completely inserted into the hook groove 153, the hook member 115 is positioned under the hook rib 154 such that the hinge unit 100 is assembled with the refrigerator door 11 (12).

Meanwhile, when the hinge unit 100 is assembled with the chilling chamber door 12 and thus the chilling chamber door 12 is installed on the main body 10 to be capable of pivoting, the chilling chamber door 12 applies force downward due to its self-gravity. Since the force is applied downward to the hook rib 154, the top surface of the hook member 115 may contact the undersurface of the hook rib 154.

As a result, the hook rib 154 is supported by the hook member 115 and thus the chilling chamber door 12 can be supported by the hinge unit 100.

In this case, the downward slipping and drooping of the chilling chamber door 12 due to the self-gravity of the chilling chamber door 12 can be prevented. Further, even when the doors 11 and 12 are repeatedly opened and closed, the doors do not droop.

In addition, in a state where the doors 11 and 12 close the front portion of the main body 10, the doors 11 and 12 can easily closely contact the main body 10.

As a result, the doors 11 and 12 close the main body 10 and thus the cool air leakage out of the interior of the refrigerator can be prevented.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

By improving the structures of the hinge unit and refrigerator door according to the embodiment, the drooping of the refrigerator door can be prevented and the refrigerator door can effectively close the main body. Therefore, the industrial applicability is remarkably high.

The invention claimed is:

1. A refrigerator comprising:

a refrigerator main body defining a storage chamber;

a refrigerator door pivotally provided on the refrigerator main body; and a hinge unit provided on the refrigerator main body and pivotally supporting the refrigerator door, the hinge unit including a hinge pin providing a pivot axis of the refrigerator door and a hook member provided at a lower end of the hinge pin, the hook member being protruded outward from the hinge pin, wherein the refrigerator door comprises:

an insertion groove in which the hinge unit is insertable; and a hook groove provided with a hook rib and enabling the hook member to be hooked on a lower part of the hook rib, the hook groove being spaced from the insertion groove in a lateral direction of the door;

a connection groove extending from the insertion groove to the hook groove, the connection groove allowing the hinge unit to move sideways from the insertion groove to the hook groove when the refrigerator door is assembled with the refrigerator main body; and an opening provided at the hook rib, the opening enabling the hinge pin to move from the insertion groove to the hook groove.

2. The refrigerator according to claim 1, wherein the hook rib is spaced apart from a bottom surface of the hook groove by a predetermined distance greater than a height of the hook member.

* * * * *